US011933006B2

(12) United States Patent
Calloway et al.

(10) Patent No.: US 11,933,006 B2
(45) **Date of Patent: *Mar. 19, 2024**

(54) MATERIAL COLLECTION SYSTEM

(71) Applicant: Old Dominion Brush Company, Henrico, VA (US)

(72) Inventors: Britt R. Calloway, Midlothian, VA (US); Robert Mayes, Hanover, VA (US); Tim Stumph, Midlothian, VA (US); Chris Turner, Aylett, VA (US)

(73) Assignee: Old Dominion Brush Company, Henrico, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/136,531

(22) Filed: Apr. 19, 2023

(65) Prior Publication Data

US 2023/0250600 A1 Aug. 10, 2023

Related U.S. Application Data

(60) Continuation of application No. 17/732,016, filed on Apr. 28, 2022, now Pat. No. 11,753,784, which is a division of application No. 17/314,760, filed on May 7, 2021, now Pat. No. 11,319,683.

(60) Provisional application No. 63/109,714, filed on Nov. 4, 2020.

(51) Int. Cl.

| | |
|---|---|
| ***E01H 1/08*** | (2006.01) |
| ***A47L 5/36*** | (2006.01) |
| ***A47L 9/24*** | (2006.01) |
| ***E01H 1/00*** | (2006.01) |

(52) U.S. Cl.

CPC ..... *E01H 1/0836* (2013.01); *A47L 5/36* (2013.01); *A47L 9/242* (2013.01); *A47L 9/248* (2013.01); *E01H 1/005* (2013.01)

(58) Field of Classification Search

CPC ..... E01H 1/0836; E01H 1/005; A47L 5/36; A47L 9/242; A47L 9/248

See application file for complete search history.

(56) References Cited

U.S. PATENT DOCUMENTS

| | | | | |
|---|---|---|---|---|
| 4,904,126 | A | 2/1990 | Voith | |
| 11,319,683 | B1 * | 5/2022 | Calloway | E01H 1/005 |
| 2002/0157212 | A1 | 10/2002 | Velinsky et al. | |
| 2022/0251792 | A1 | 8/2022 | Calloway et al. | |

FOREIGN PATENT DOCUMENTS

| | | | |
|---|---|---|---|
| KR | 101773422 | B1 | 8/2017 |

* cited by examiner

*Primary Examiner* — David Redding

(74) *Attorney, Agent, or Firm* — Sterne, Kessler, Goldstein & Fox P.L.L.C.

(57) ABSTRACT

The present disclosure provides a material collection system. The material collection system includes a conduit, a vacuum generator coupled to the conduit, an engine powering the vacuum generator, and a container mounted to a chassis of a vehicle. The vacuum generator generates airflow for drawing material into a material inlet of the conduit. The container receives collected material from the conduit. The conduit, vacuum generator, the engine, and the container are supported on a hook-lift frame.

20 Claims, 14 Drawing Sheets

| Pump Switching Circuit Logic for Deadman | | | |
|---|---|---|---|
| Inputs | | Outputs | |
| Deadman | 3 Position Switch | Pump | Hi Speed Throttle |
| 0 | Eco | Off | Off |
| 0 | Lo | Off | Off |
| 0 | Hi | Off | On |
| 1 | Eco | On | On |
| 1 | Lo | On | Off |
| 1 | Hi | On | On |

FIG. 14

MATERIAL COLLECTION SYSTEM

CROSS-REFERENCE TO RELATED APPLICATIONS AND INCORPORATION BY REFERENCE

This application is a continuation of U.S. patent application Ser. No. 17/732,016, filed Apr. 28, 2022, which is a divisional of Ser. No. 17/314,760, filed May 7, 2021, which claims priority to U.S. Provisional Patent Application No. 63/109,714 filed on Nov. 4, 2020; which are incorporated by reference herein in their entirety for all purposes.

FIELD

The present disclosure generally relates to a material collection system. In particular, embodiments relate to a compact material collection system.

BACKGROUND

Material collection equipment can be used to intake a variety of debris for removal and disposal. Some material collection equipment can include additional functionality such as cleaning, sweeping, and excavation. Some equipment can be fixed to a vehicle or a trailer pulled by a vehicle. Material collection equipment can utilize a number of mechanisms for debris intake.

However, material collection equipment are typically bulky and heavy, thereby relying on a heavy duty vehicle to transport the material collection system to a pickup site and power the collection equipment. Using heavy duty vehicles to navigate narrow roads and access constrained pickup sites can be challenging. Furthermore, drivers usually need commercial driver licenses to operate heavy duty vehicles.

BRIEF SUMMARY

Thus, there is a need for a lighter and compact material collection system that can be transported by a light duty, non-commercial vehicle, while still having ample storage capacity to carry a sufficient amount of collected material and provide sufficient power to operate material collection equipment efficiently.

One aspect of the invention can provide a material collection system mounted on a vehicle, in which the material collection system includes a conduit, a boom, a vacuum generator, an engine, and a material collection container. The conduit can include a material inlet and be coupled to a vacuum generator. The boom can support the conduit and be movable from a stowed position to an operating position. The vacuum generator can generate an airflow for drawing material into the material inlet. The engine can power the vacuum generator. The material collection container can receive the collected material from the conduit. The material collection container can include a nose extension disposed at a front end of the container, and the vacuum generator and the engine are disposed below the nose extension of the material collection container.

In some aspects, the material collection system further comprises a hydraulic system configured to move the boom between the stowed position and the operating position to adjust a location of the material inlet of conduit.

In some aspects, the engine can be a diesel engine. In some aspects, the vacuum generator includes an impeller, and the impeller has a diameter in a range of approximately 18 inches to approximately 22 inches. In some aspects, the vacuum generator is configured to generate the airflow at a volumetric flow rate between approximately 4,000 cubic feet per minute ("CFM") and approximately 10,000 CFM for drawing material into the material inlet.

In some aspects, the material collection system can include a hook-lift frame removably mounted to a chassis of the vehicle. The vacuum generator, the engine, and the material collection container can be supported on the hook-lift frame. The hook-lift frame can move the vacuum generator, the engine, and the material collection container on and off the chassis of the vehicle. In some aspects, the hook-lift frame can include a base that can be removably mounted to the chassis of the vehicle, and a platform rotatably coupled to the base. In some aspects, the vacuum generator, the engine, and the material collection container are received on the platform. In some aspects, the hook-lift frame can include a frame hydraulic actuator operatively connected to the base and the platform. In some aspects, the frame hydraulic actuator can pivot the platform between a loading position and an unloading positon.

In some aspects, the material collection container can define a storage volume in a range of approximately 10 cubic yards to approximately 20 cubic yards.

In some aspects, the material collection system can include a nose extension that includes an inlet defining an opening into the container and disposed at a bottom end of the nose extension. In some aspects, the vacuum generator includes an outlet port directly connected to the inlet of the nose extension. In some aspects, the bottom end of the nose extension is inclined at an angle in a range between 5 degrees and 40 degrees with respect to a plane extending parallel to the ground.

One aspect of the invention can provide a material collection system that includes a conduit, a vacuum generator, an engine, a material collection container, and a control system. The conduit can include a material inlet. The vacuum generator can generate airflow for drawing material into the material inlet. The engine can power the vacuum generator. The material collection container can receive collected material from the conduit. The control system can include a load sensor and a controller in electrical communication with the load sensor. The load sensor can detect a load applied by the collected material received in the material collection container and transmit an output signal indicating the load applied by the collected material. The controller can determine a weight of the collected material received in the material collection container based on the output signal and determine an aggregate weight of the vehicle using the determined weight of the collected material.

In some aspects, the load sensor can detect the load applied by the collected material by monitoring the displacement between the chassis of the vehicle and an axle of the vehicle. In some aspects, controller can use the monitored displacement between the chassis and the axle of the vehicle to calculate the weight of collected material received in the material collection container.

In some aspects, the load sensor can detect the load applied by the collected material by measuring a force applied to the chassis of the vehicle. In some aspects, the controller can use the monitored force applied to the chassis of the vehicle to calculate the weight of collected material received in the material collection container.

In some aspects, the controller can compare the determined aggregate weight to a maximum operating weight. In some aspects, the maximum operating weight is less than approximately 26,000 lbs. In some aspects, the maximum operating weight ranges between approximately 19,000 lbs. and approximately 26,000 lbs. In some aspects, the control system further includes a display unit in electrical communication with the controller. In some aspects, the display unit can display the determined aggregate weight of the vehicle.

In some aspects, in response to determining that the aggregate weight of the vehicle exceeds the maximum operating weight, the controller can actuate the display unit to indicate an alarm warning. In some aspects, in response to determining the aggregate weight of the vehicle exceeds the maximum operating weight, the controller can adjust a speed of the vacuum generator to an idle speed. In some aspects, the ideal speed corresponds to the engine set at approximately 1,200 RPM.

BRIEF DESCRIPTION OF THE FIGURES

The accompanying drawings, which are incorporated herein and form part of the specification, illustrate embodiments and, together with the description, further serve to explain the principles of the embodiments and to enable a person skilled in the relevant art(s) to make and use the embodiments.

FIG. 14 is a chart indicating pump switching circuit logic for deadman of a joystick controller according to various aspects of the invention.

Figure 1:
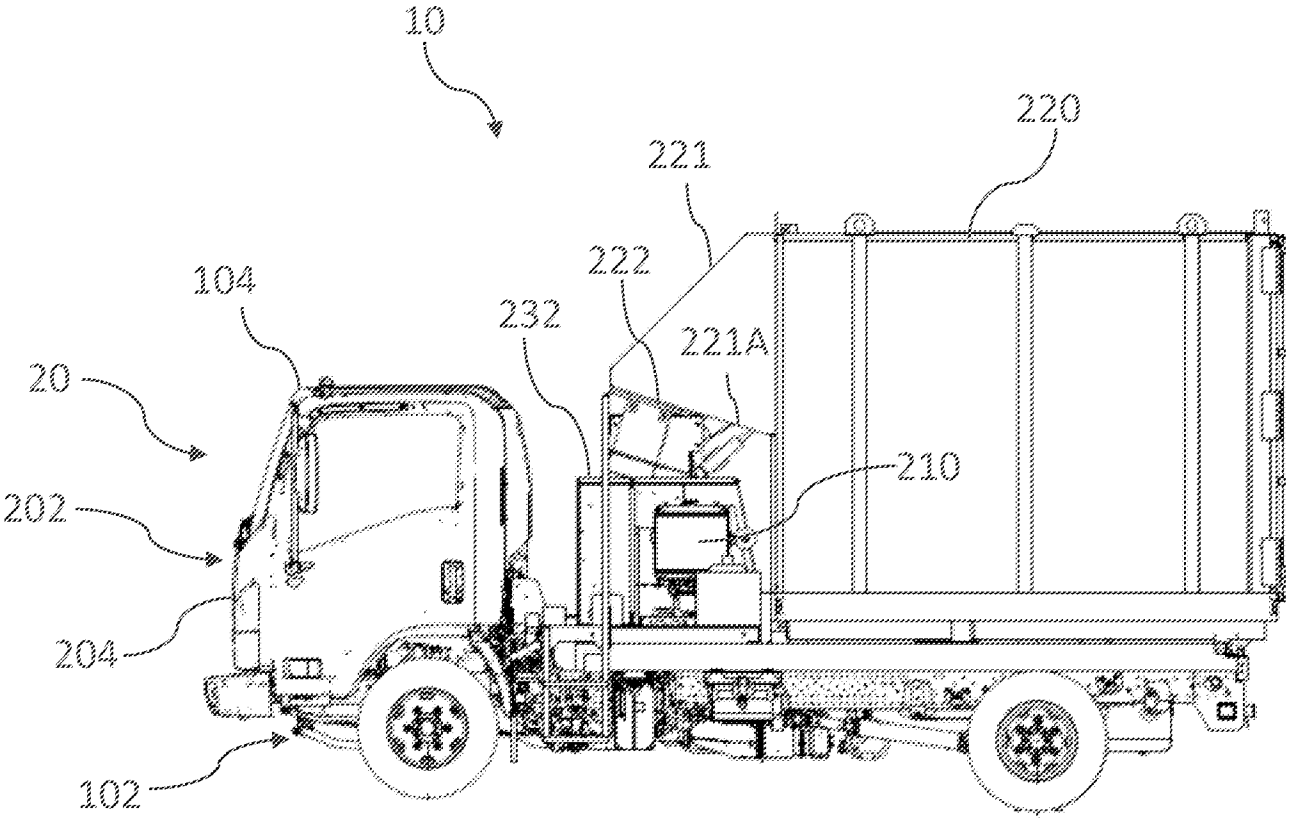
FIG. 1 is a side view of a vehicle with material collection equipment according to various aspects of the invention.

The features and advantages of the embodiments will become more apparent from the detail description set forth below when taken in conjunction with the drawings, in which like reference characters identify corresponding elements throughout. In the drawings like reference numbers generally indicate identical, functionally similar, and/or structurally similar elements.

DETAILED DESCRIPTION

Embodiments of the present disclosure are described in detail with reference to embodiments thereof as illustrated in the accompanying drawings. References to "one embodiment," "an embodiment," "an exemplary embodiment," etc., indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present embodiments. Other suitable modifications and adaptations of the variety of conditions and parameters normally encountered in the field, and which would be apparent to those skilled in the art, are within the spirit and scope of the disclosure.

Material collection systems use several components, such as extension hoses, engine-powered pneumatic pumps, and large containers to collect material from a pickup site. Due to the size and weight of such equipment, material collection systems can be fixed to the chassis of the vehicle or a trailer to provide proper support for the equipment.

Moreover, material collection equipment can be bulky and heavy, thereby relying on a heavy duty vehicle to transport the material collection system to a pickup site and power the collection equipment. Using heavy duty vehicles to navigate narrow roads and access constrained pickup sites can be challenging. Furthermore, an operator may need a commercial driver's license to operate a heavy duty vehicle.

Embodiments of the present disclosure provide a material collection system that overcomes the deficiencies described above by featuring a compact design that allows a material collection system to be more accessible to drivers and operators that do not have a commercial driver's license.

In some aspects, the material collection system can include a conduit having a material inlet, a boom supporting the conduit, a vacuum generator configured to generate airflow for drawing material into the material inlet, an engine configured to power the vacuum generator, and a material collection container to receive the collected material from the conduit. In some aspects, the conduit, the vacuum generator, the engine, and the material collection container can be supported on a hook-lift frame, and the hook-lift frame can be configured to move the conduit, the vacuum generator, the engine, and the material collection container on and off the chassis of the vehicle. In some aspects, the material collection container can defines a storage volume in a range (e.g., approximately 10 cubic yards to approximately 18 cubic yards) that allows the vehicle to support the material collection container with a shorter wheelbase, thereby enhancing the maneuverability of the vehicle.

The material collection system can further include a control system that monitors the weight of the collected material so that a vehicle operator can ensure that the vehicle for transporting and driving the material collection equipment complies with non-commercial vehicle requirements. For example, the control system can include a load sensor configured to detect a load applied by the collected material received in the material collection container and transmit an output signal indicating the load applied by the collected material. The control system can include a controller in communication with the load sensor, whereby the controller is configured to determine a weight of the collected material received in the material collection container based on the output signal and determine an aggregate weight of the vehicle using the determined weight of the collected material.

Typically, collection trucks that operate in the material collection industry have a gross vehicle weight rating (GVWR) of 33,000 lbs. to 35,000 lbs. The higher GVWR is attributed to conventional collection trucks having a large payload capacity in a range from 20 cubic yards to 30 cubic yards and bulky equipment—a box and hoist weight—required to support these loads. These trucks also typically include additional weight due to an auxiliary engine with a power capacity in a range between 74 horsepower to 99 horsepower. The auxiliary engine and supporting chassis to handle large payload all increase the total curb weight of these trucks. Therefore, trucks for carrying and transporting material collection systems meeting these collection and size requirements have a GVWR over 26,000 lbs., thereby requiring a commercial driver's license for the vehicle operator to legally operate the vehicle.

Figure 2:
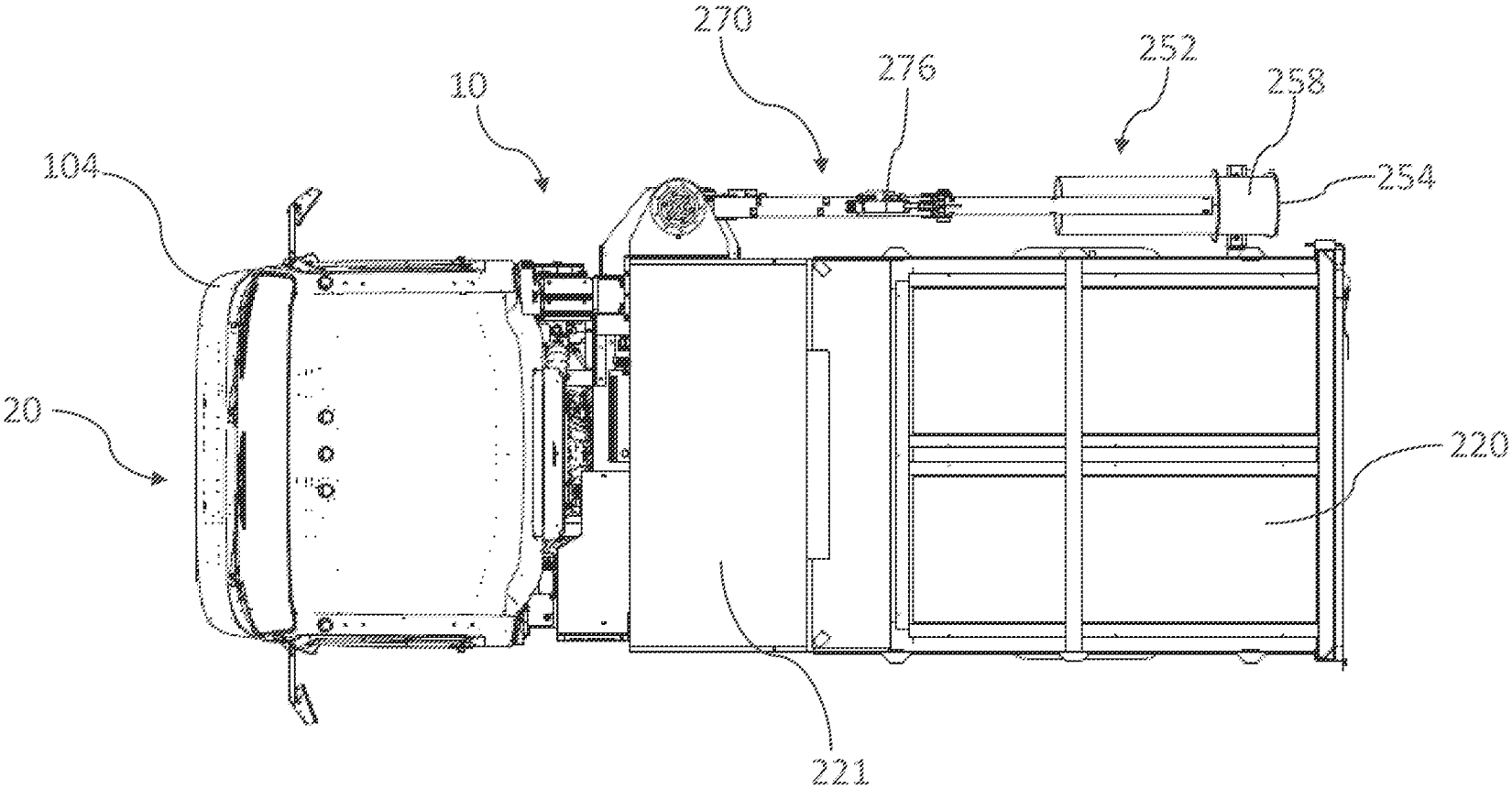
FIG. 2 is a top view of a vehicle with material collection equipment according to various aspects of the invention.
Figure 3:
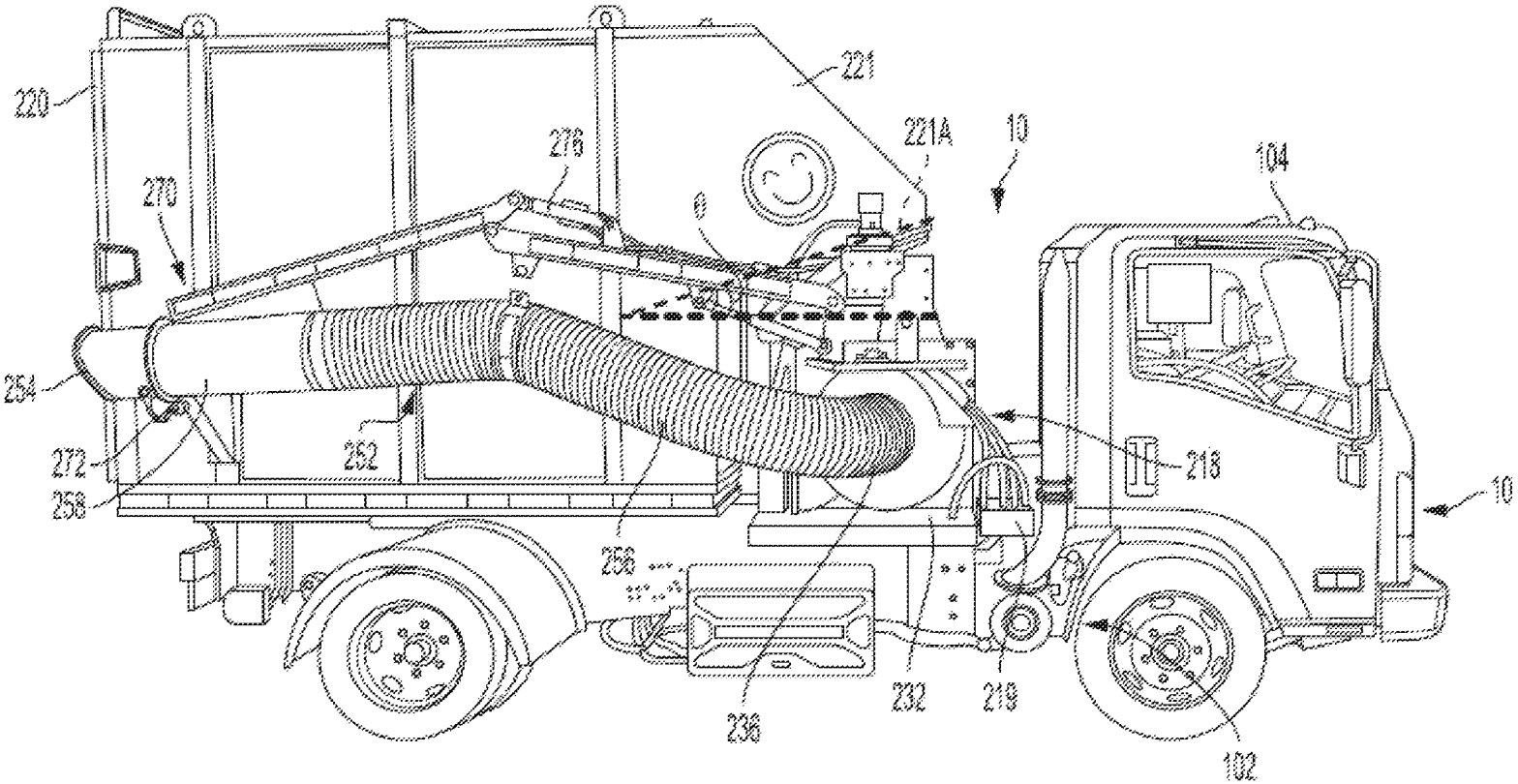
FIG. 3 is a side view of a vehicle with material collection equipment according to various aspects of the invention.

Embodiments will now be described in more detail with reference to the figures. With reference to FIGS. 1-3, in some aspects, a material collection system 10 can be mounted to a vehicle 20, which can be, for example, a truck. Vehicle 20 can include components, such as a chassis 102 and/or a cab 104 mounted on chassis 102. In some aspects, material collection system 10 and vehicle 20 can have a GVWR below 26,000 lbs., such as a GVWR in a range between approximately 14,000 lbs. and approximately 26,000 lbs., such as in a range between approximately 19,000 lbs. and approximately 26,000 lbs. Maintaining the GVWR of material collection system 10 and vehicle 20 in this manner can allow for material collection system 10 to be legally operated by a user without a commercial driver's license.

Figure 4:
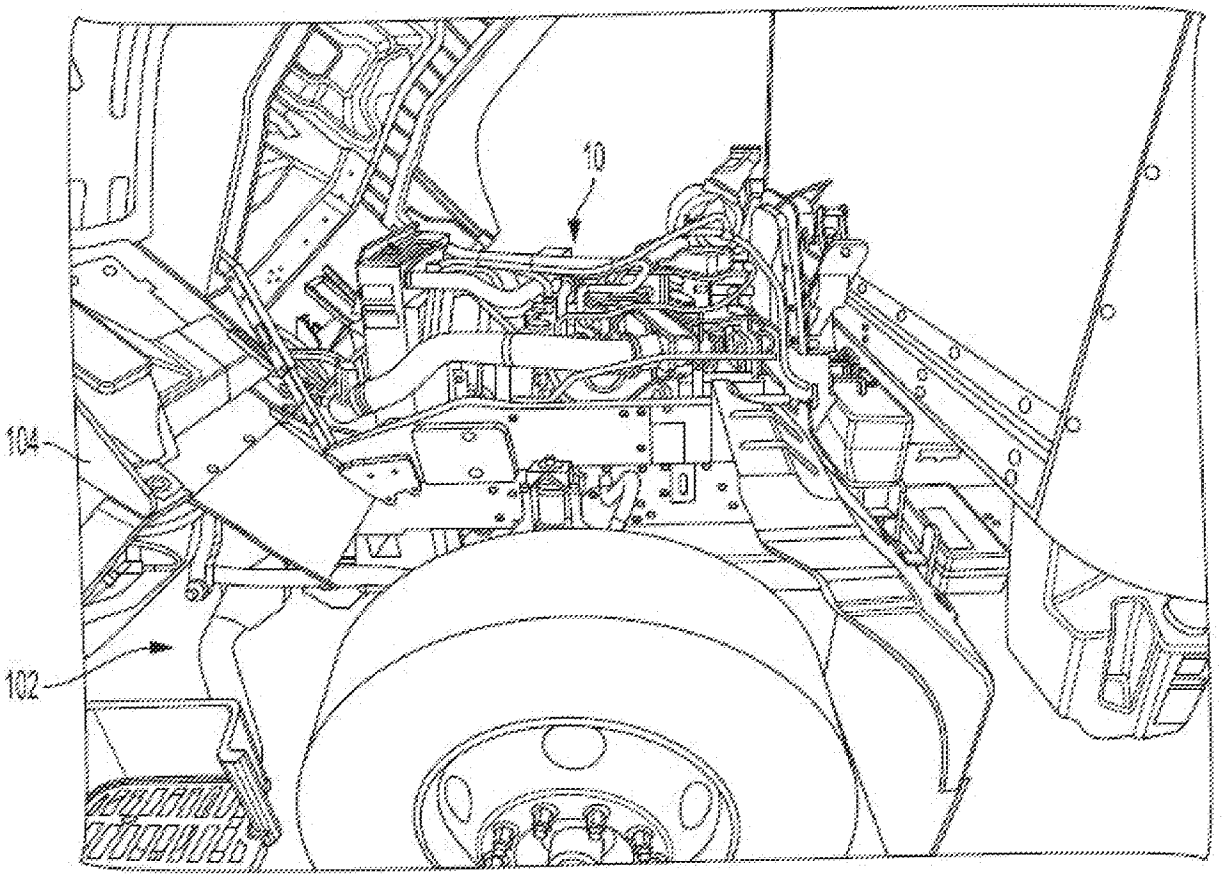
FIG. 4 is a detailed view of a vehicle cab hinged forward according to various aspects of the invention.

In some aspects, with reference to FIG. 4, cab 104 can be pivotably coupled to chassis 102 by a hinge such that cab 104 can pivot forward to provide more space to access components (e.g., auxiliary engine, hydraulic valve block) of material collection system 10 disposed ahead of a collection container 220. The hinged cab design facilitates easier access to the components while maintaining a compact and lightweight overall design.

In some embodiments, material collection system 10 can include a number of material collection system components, such as a power source 202, a container 220, a vacuum generator 232, a conduit 252, a boom 270, and/or a hook-lift frame 280. Container 220 can be enclosed to receive and retain the material and debris within its interior area. In some aspects, any one of power source 202, container 220, vacuum generator 232, conduit 252, and/or boom 270 can be supported on hook-lift frame 280 to load components of material collection system 10 on chassis 102 of vehicle 20 and unload components of material collection system 10 from chassis 102 of vehicle 20. In another aspect, any one of power source 202, container 220, vacuum generator 232, conduit 252, and/or boom 270 can be directly supported on chassis 102 of vehicle 20.

In an aspect, material collection system 10 including power source 202, an enclosed container 220, vacuum generator 232, conduit 252, boom 270, and vehicle 20 can have a GVWR below 26,000 lbs., such as a GVWR in a range from approximately 14,000 lbs. to approximately 26,000 lbs., such as in a range from approximately 19,000 lbs. to approximately 26,000 lbs.

In some aspects, an operator can reside in cab 104 and drive vehicle 20 to a material pickup site. In some aspects, the operator can reside in cab 104 during a material collection operation and operate the material collection system 10 from inside the cab. In another aspect, the operator and/or a second operator can manually control material collection system 10 components. For example, the operator can reside in cab 104, and a second operator can be external to the cab. The second operator can manually move conduit 252 and can manually position conduit 252 for material collection.

Figure 5:
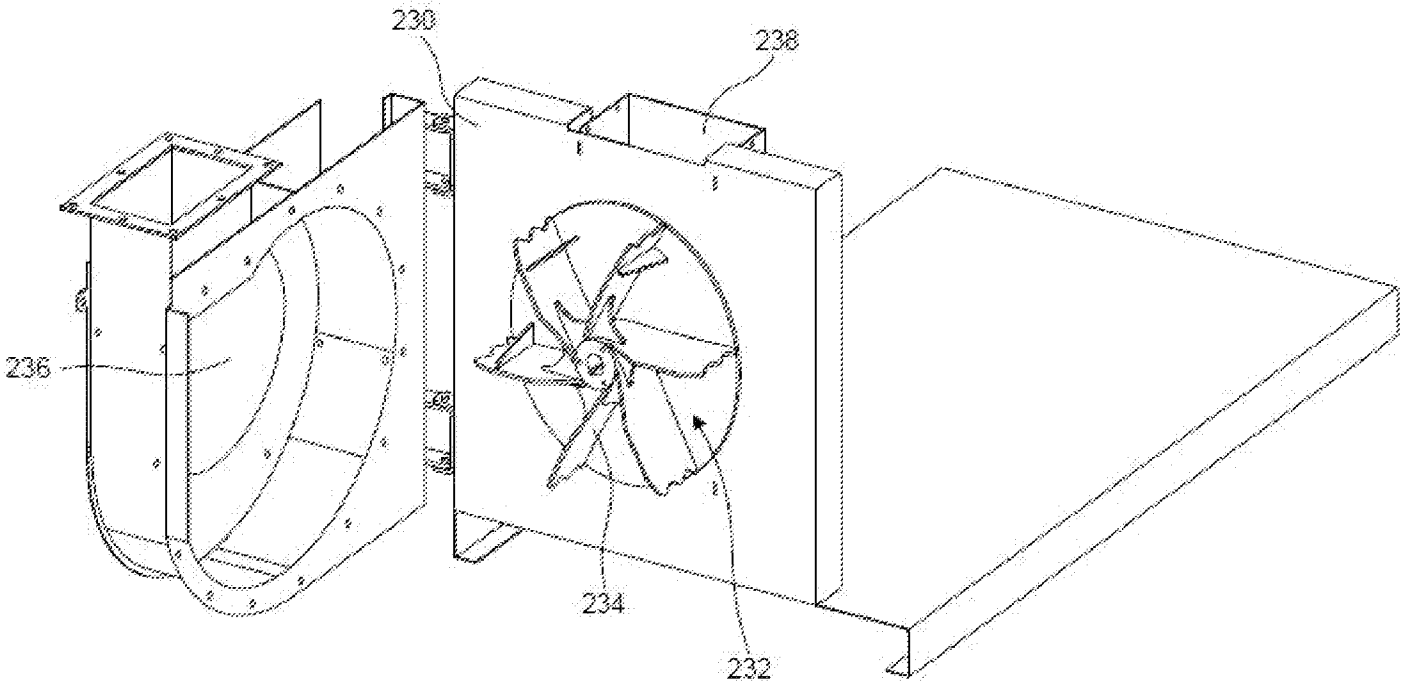
FIG. 5 is a perspective view of a vacuum generator according to various aspects of the invention.

With reference to FIGS. 1, 3, and 5, in some aspects, vacuum generator 232 can be disposed approximate to a front end of container 220 and behind cab 104. In some aspects, vacuum generator 232 can be in fluid communication with conduit 252 and container 220. For example, conduit 252 can be removably coupled to an inlet port 236 of vacuum generator 232. In some aspects, vacuum generator 232 can generate an airflow for drawing material through an intake end 258 of conduit 252 and propelling material to an inlet 222 of container 220 such that container 220 receives material collected through conduit 252.

In some aspects, as shown in FIGS. 1-3, for example, container 220 can include a nose extension 221 disposed at the front end of container 220. In some aspects, nose extension 221 can extend across the entire width of container 220. In some aspects, nose extension 221 can be shaped as a truncated-pyramid. Other components of material collection system 10 (e.g., vacuum generator 232, auxiliary engine 210, hydraulic valve block 219) can be disposed below nose extension 221. By extending above other components of material collection system 10, nose extension 221 can increase the storage capacity of container 220, while still allowing material collection system 10 to have a compact design. For example, nose extension 221 can increase the storage capacity of container 220 by approximately two cubic yards. In some embodiments, nose extension 221 can increase the payload capacity by up to 15% and can provide a more uniform loading between the two axles of vehicle 20.

In some aspects, nose extension 221 can include a bottom end 221A projecting from the front end of container 220, such as for example, at an approximate midpoint along the height of container 220. In some aspects, bottom end 221A can include inlet 222 and can define an opening into container 220. Bottom end 221A of nose extension 221 can be directly connected to outlet port 238 of vacuum generator 232 to receive collected material. The shape of nose extension 221 can be configured to increase the storage capacity of container 220. For example, as shown in FIG. 3, bottom end 221A of nose extension 221 can be inclined at an angle θ with respect to a plane extending parallel to horizontal. In an aspect, angle θ can be in a range of approximately 5 degrees to approximately 40 degrees, such as approximately 10 degrees to approximately 30 degrees.

Figure 6:
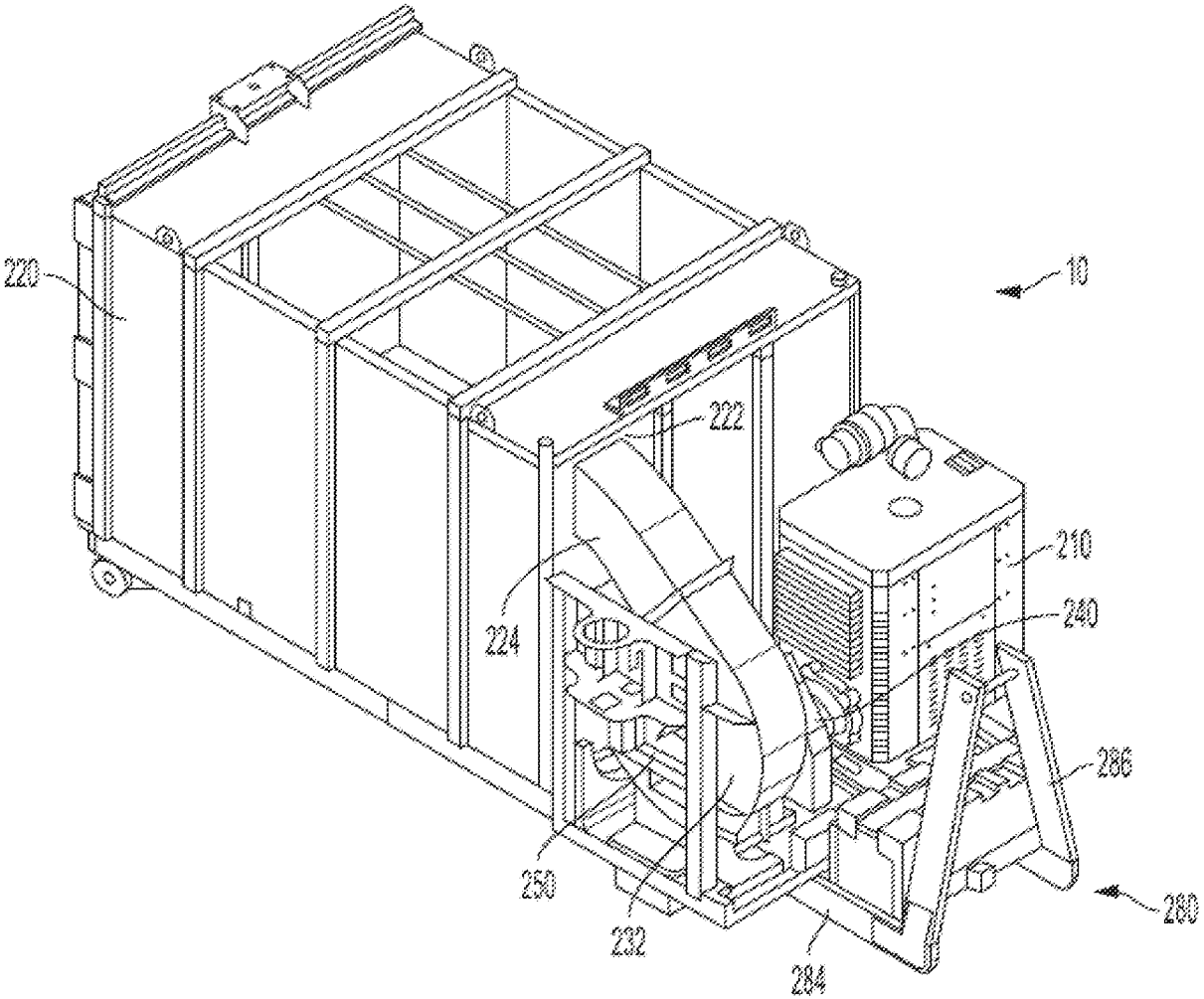
FIG. 6 is a perspective view of a material collection system (conduit and boom are omitted) according to various aspects of the invention.

In some aspects, as shown in FIG. 6, for example, container 220 can have a duct 224, rather than a nose extension, extending from an inlet of container 220 to an outlet port 238 of vacuum generator 232 to convey collected material from vacuum generator 232 to container 220.

In some aspects, the airflow developed by vacuum generator 232 can retrieve material from the pickup site. For example, the airflow generated by vacuum generator 232 can create a substantial air pressure differential between conduit 252 and the ambient air of the area surrounding intake end 258 of conduit 252 to draw material into conduit 252. In some aspects, material disposed in the pickup site can be drawn by the airflow through intake end 258 and travel through conduit 252 and vacuum generator 232.

In some aspects, material can be moved through inlet 222 of container 220. In some aspects, container can have an inlet 222 to facilitate intake of material. In some aspects, container 220 can further include an outlet for exhausting the airflow into the ambient environment. In other aspects, airflow can be recirculated to develop a regenerative vacuum in vacuum generator 232. In some aspects, material can be collected in container 220.

In an aspect, container 220 can be sized to permit sufficient collection of material and debris, but to prevent an operator from exceeding a gross vehicle weight of 26,000 lbs. In some aspects, container 220 can define a storage volume in a range between approximately eight cubic yards to approximately 18 cubic yards, such as approximately 10 cubic yards to approximately 14 cubic yards. By defining a storage volume between approximately eight cubic yards and approximately 18 cubic yards, container 220 can include dimensions (e.g., width, height, length) that allow center of gravity to be placed optimally between a vehicle axle that supports or disposed directly under an auxiliary engine 210 of material collection system 10. Furthermore, by defining a storage volume between approximately 8 cubic yards and approximately 18 cubic yards, container 220 can include dimensions that allow vehicle 20 to have a shorter wheelbase for a tight turn radius. For example, container 220 can include a length in a range between approximately 8 feet and approximately 12 feet, such as a length of approximately 9 feet, and container 220 can include a width in a range between approximately 7.0 feet and approximately 7.5 feet. By defining a storage volume between 8 cubic yards and 18 cubic yards, container 220 can include sufficient storage capacity to hold substantial loads of collected material and debris without exceeding a gross vehicle weight of 26,000 lbs. In some embodiments, container 220 can include a width of 7.5 feet (e.g., 90 inches) and a length of 9.1 feet (e.g., 109 inches). By having the dimensions disclosed herein, container 220 allows for optimal payload capacity and provides an entire material collection system, including boom 270, within the National Highway Traffic Safety Administration's maximum width limit without special permitting of 102 inches.

In some aspects, container 220 can be configured to facilitate quick and efficient removal of collected material held in container 220. For example, container 220 can include dump doors disposed at a back end of container 220. The dump doors can include hinges pivotably coupling a top of the dump doors with a body of container 220. By locating hinges at top of the dump doors of container 220, the dump doors pivot upward to empty collected material out of container 220. In some aspects, container 220 can include a mulch blower disposed in the container 220 and proximate to the dump doors. The mulch blower can be configured to generate an air stream for propelling collected material out of container 220.

In some aspects, vacuum generator 232 can include a motor 240 configured to drive vacuum generator 232. In some aspects, motor 240 can be an electrical motor powered by power source 202 (e.g., a chassis engine 204, an auxiliary engine 210, and/or a power takeoff 216).

Figure 7:
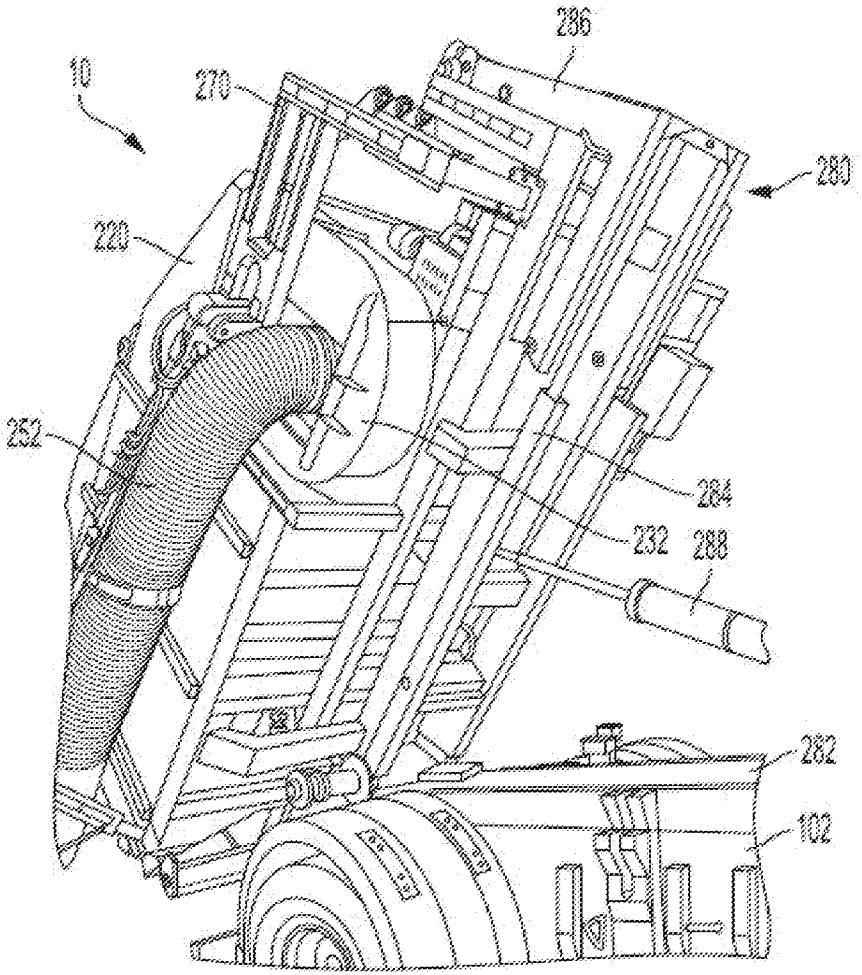
FIG. 7 is a perspective view of a material collection system disposed on a vehicle chassis according to various aspects of the invention.

With reference to FIG. 7, in some aspects, vacuum generator 232 can be, for example, a fan, such as centrifugal fan or an axial fan. In some aspects, the fan of vacuum generator 232 can include a propeller having a plurality of blades 234 that can rotate when powered to develop a sub-atmospheric pressure airflow. The blades can also chop incoming material into small pieces as the material passes the blades. In some aspects, the propeller can include a diameter in a range between approximately 18 inches and approximately 22 inches. In some aspects, the propeller can include a diameter of approximately 20 inches. In some aspects, the fan of vacuum generator 232 can generate a volumetric flow rate in a range between approximately 4,000 CFM and approximately 10,000 CFM, such as approximately 6,000 CFM to approximately 8,000 CFM.

In some aspects, vacuum generator 232 can include a housing 230 partially enclosing the fan. In some aspects, housing 230 can include the outlet port 238 connected to container 220 via duct 224. In some aspects, housing 230 can include inlet port 236 for receiving an outlet end of conduit 252. In some aspects, housing 230 can be pivotably coupled to a frame by a hinge such that housing 230 can be pivoted to provide access to the propeller for servicing.

In some aspects, conduit 252 can extend away from vacuum generator 232 and terminate at intake end 258. In some aspects, conduit 252 can be comprised of a flexible material (e.g., elastic material) so that the conduit 252 can be bent or flexed to adjust the position of intake end 258 to a variety of positions around the pickup site surrounding vehicle 20. In some aspects, conduit 252 can include an interior wall 254 and/or an exterior wall 256. In some aspects, interior wall 254 can be configured to support the airflow through conduit 252. For example, interior wall 254 can be smooth and free of obstructions. In some aspects, one or more sections of interior wall 254 and/or exterior wall 256 can include corrugated plastic. In some aspects, interior wall 254 and/or exterior wall 256 can include plastics, metals, composites, or a combination thereof.

In some aspects, boom 270 can be configured to lift and support conduit 252. In some aspects, boom 270 can be in rack 272 such that boom 270 can be in a storage position. In the storage position, boom 270 can be substantially parallel to chassis 102. In some aspects, conduit 252 can extend outward from vehicle 20 such that boom 270 can be in a deployed position.

In some aspects, the amount of conduit 252 that extends from vehicle 20 is adjustable such that conduit 252 can extend from vehicle 20 more or less, depending on the pickup site. In some aspects, the extension of conduit 252 can be adjusted before or during a material collection operation. In some aspects, conduit 252 can include a length in a range between approximately 6 feet and approximately 12 feet, such that the length of conduit 252 provides a sufficient range of reach to collect material around vehicle 20, while minimizing weight. In some aspects, conduit 252 can include a diameter in a range between approximately 10 inches and approximately 16 inches, such that the power source (e.g., auxiliary engine 210 and motor 240) can operate effectively with less power capacity to generate sufficient suction force within conduit 252 to collect material.

In some aspects, boom 270 can be moved (e.g., by one or more hydraulic actuators 276) from a lower position (e.g., a position substantially parallel to chassis 102), to a higher position (e.g., a position at an angle relative to chassis 102). In an aspect, the lower position can be storage position and the higher position can be deployed position. In other aspects, boom 270 can control movement of conduit 252 (e.g., by one or more hydraulic actuators 276) such that the position of intake end 248 can be adjusted in longitudinal direction, a lateral direction, and/or a vertical direction. In some aspects, the combination of moveable boom 270 and conduit 252 can provide flexible positioning of intake end 248 at pickup sites.

In some aspects, material collection system 10 can pick up and remove material from a pickup site of various composition and/or sizes. For example, the material can be natural debris (e.g., leaves, branches, or dirt), recyclables (e.g., plastics, metals, or papers), and/or waste (e.g., food waste or non-recyclables). Debris, such as natural debris, can further include particulate matter (i.e., matter suspended in air). In some aspects, conduit 252 and container 220 can be configured to intake and contain a plurality of different types of materials, respectively. Intake end 258 can include a plurality of attachments to enable intake of a plurality of materials. For example, intake end 258 can include a cutting attachment (not shown) configured to cut, for example, wet leaves and/or plastic waste so that the material can be collected by material collection system 10. Thus, while the cross-sectional area of conduit 252 and intake end 248 can be fixed in some embodiments, material collection system 10 is capable of receiving larger sized material and material of different shapes.

In other aspects, intake end 258 can include material for engagement with a plurality of materials. For example, material can include rigid materials such as rocks which can damage material collection system 10 and/or vehicle 20. Intake end 258 can contain metal (e.g., steel) such that intake end 258 retains its structure when engaging with certain materials. This embodiment can be included for certain applications, such as excavation (i.e., breakage of material for collection and disposal). In some aspects, a broom attachment (not shown) configured to sweep a surface can attach to intake end 258 and/or another part of material collection system 10. The broom attachment can be used for collection of material for intake. In some aspects, airflow can be recirculated within the broom attachment to contain particulate matter. In some aspects, intake end 258 of conduit 252 can include a rigid nozzle integrated with boom 270. In some embodiments, the rigid nozzle of intake end 258 can be welded to boom 270. The rigid nozzle of intake end 258 allows for more precise control over the motion of intake end 258, which is well suited for material collection system 10 operating in more restrictive environments. In contrast, prior art debris collector nozzle designs typically include a sheet metal tube that hangs from a boom via a chain or a rigid link. While such prior art designs allows the nozzle to be flexible, the flexibility of prior art nozzles typically cannot be controlled precisely such that prior art nozzles are prone to swinging into parked cars and causing property damage. If there is a wet pile of leaves, or leaves with large sticks, then the nozzle's inertia can be used to break up the sticks. However, the rigid nozzle of intake end 258 provides more precise control of movement compared to prior art nozzles, thereby allowing material collection system 10 to operate in more restrictive environments.

In some aspects, particulate matter such as leaf dust can require additional processing for containment in container 220. Containment of particulate matter can prevent it from exhausting through outlet and returning to the environment. Exhausting particulate matter can be undesirable as it can return material to the environment and can impair nearby operators (e.g., operators can breathe in particulates or hurt their eyesight). Leaf material, for example, can include dry leaves and/or wet leaves. Leaves, because of their weight, can be directed downward through container 220. However, dry leaves can include leaf dust which cannot be similarly directed downward. In some aspects, material collection system 10 can further include a water system (not shown), such as a water tank, a water pump, and/or a water line.

In some aspects, the arrangement and size of the components of material collection system 10, such as, power source 202 (e.g., auxiliary engine 210), vacuum generator 232, motor 240, and conduit 252, are configured to provide a modular system such that material collection system 10 may be removably mounted to chassis 102 of vehicle 20. For example, a user can set vehicle 20 for a removal operation by coupling material collection system 10 on chassis 102 and can set vehicle 20 for an alternative operation, such as a dumping operation, by removing material collection system 10 from chassis 102.

In some aspects, any one of power source 202, container 220, vacuum generator 232, conduit 252, and/or boom 270 can be supported on hook-lift frame 280 to move components of material collection system 10 on and off chassis 102 of vehicle 20. In some aspects, hook-lift frame 280 can include a base 282 configured to be removably mounted on the chassis 102 of vehicle 20. In some aspects, base 282 can be mounted to chassis 102 using any suitable fastener, such as, for example, bolts, rivets, brackets, clamps, etc. In some aspects, hook-lift frame 280 can include a platform 284 rotatably coupled to base 282. In some aspects, platform 284 can include a post 286 (e.g., pair of angled tubes) projecting from a front end of platform 284. In some aspects, a back end of platform 284 can be connected to base 282 by a joint (e.g., hinge, pin) such that platform 284 can pivot about the joint to move between a loading position and an unloading position. In some aspects, vacuum generator 232, a component of power source 202 (e.g., auxiliary engine 210, hydraulic motor pump, etc.), container 220, conduit 252, and/or boom 270 can be received on the platform 284.

In some aspects, hook-lift frame 280 can include a frame hydraulic actuator 288 operatively connected to base 282 and platform 284. In some aspects, frame hydraulic actuator 288 can be configured to pivot platform 284 between a loading position and an unloading positon. At the loading position, platform 284 can extend substantially parallel with respect to base 282 and chassis 102 of vehicle 20. At the unloading position, platform 284 can be tilted with respect to base 282 and chassis 102 of vehicle 20 so that components of material collection system 10 can be moved on and off chassis 102.

Figure 8:
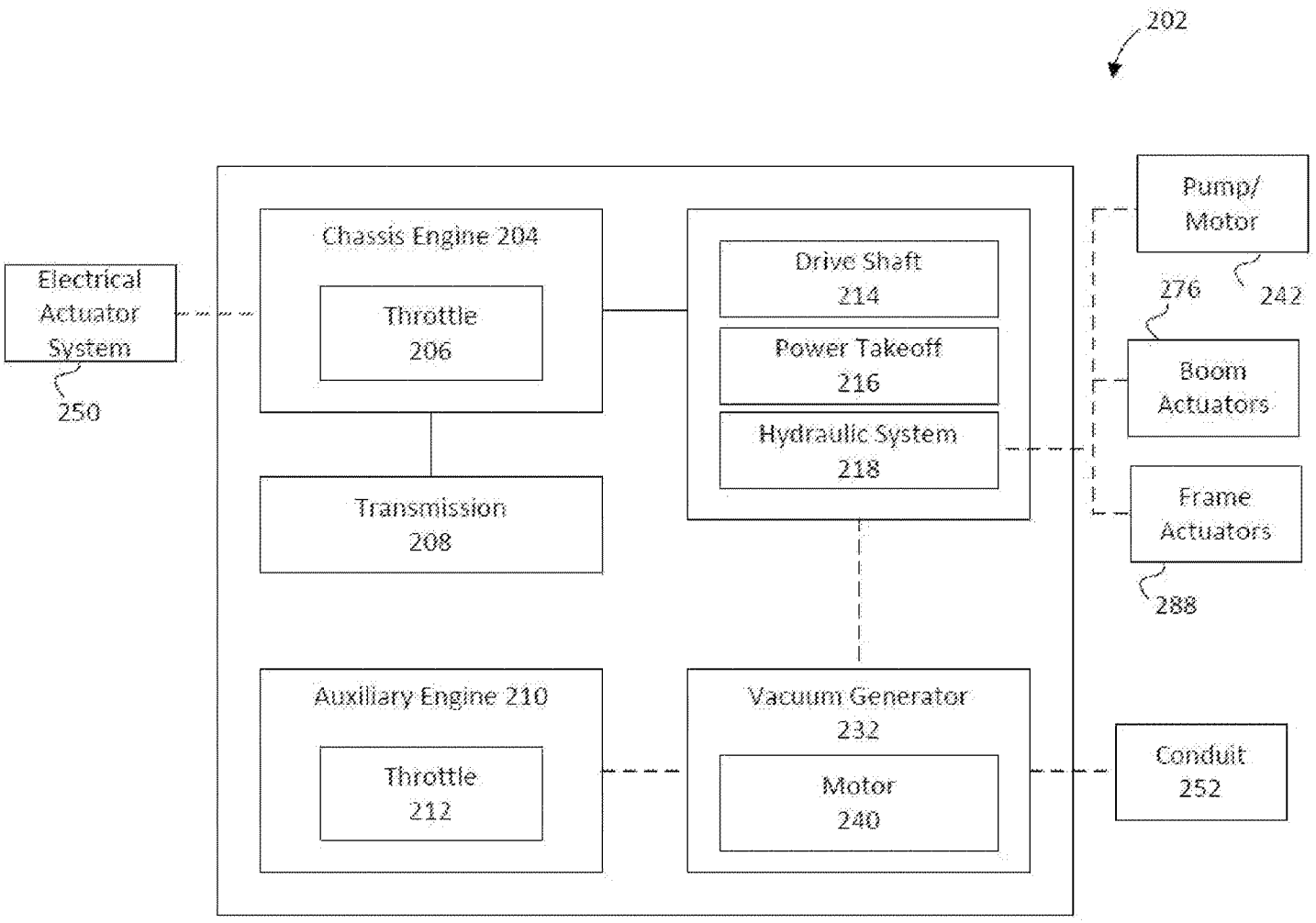
FIG. 8 is a block diagram of a power source for material collection system according to various aspects of the invention.

In some aspects, power source 202 can provide power to various components of material collection system 10. For example, power source 202 can power vacuum generator 232. With reference to FIG. 8, in some aspects, power source 202 can include chassis engine 204, a throttle 206, a transmission 208, an auxiliary engine 210, a throttle 212, a drive shaft 214, power takeoff(s) 216, and/or a hydraulic system 218. In some aspects, power source 202 can power material collection equipment, such as vacuum generator 232.

In some aspects, power source 202 can provide motive power to vehicle 20. For example, power source 202 can include a chassis engine 204 (i.e., a primary engine powering vehicle 20) that moves vehicle 20. In some aspects, chassis engine 204 can be an internal combustion engine. In another aspect, chassis engine 204 can include an electric motor powered by a battery source. In one aspect, power source 202 can include any components of the vehicle's electrical system, such as a direct current (DC) power unit. In some aspects, chassis engine 204 can provide power to drive vacuum generator 232 and/or other material collection system 10 equipment. Chassis engine 204 can, for example, power vacuum generator 232 using drive shaft 214, a power takeoff(s) 216, a hydraulic system 218, or indirectly via a drive belt system (not shown). In some aspects, throttle 206 can control the power output of chassis engine 204.

In some aspects, power source 202 can include an auxiliary engine 210 disposed proximate to a front end of container 220 and below nose extension 221 of container 220. In some aspects, auxiliary engine 210 can be configured to power vacuum generator 232 or other components of material collection system 10. In some aspects, auxiliary engine 210 can be a spark-ignited engine (e.g., 27 horsepower gasoline engine) or a compressed-ignition engine (e.g., 24 horsepower diesel engine). In some aspects, auxiliary engine 210 can include an electrical motor and can be powered by a battery source. In some aspects, the power of auxiliary engine 210 can be in a range between approximately 20 horsepower and approximately 87 horsepower such that the volumetric flow rate capacity of vacuum generator 232 can be between approximately 4,000 CFM and approximately CFM. In an aspect, the power of auxiliary engine 210 can be in a range between approximately 20 horsepower and approximately 60 horsepower, such as approximately horsepower to approximately 45 horsepower, such as approximately 20 horsepower to approximately 30 horsepower. In an aspect, the power of auxiliary engine 210 can be below approximately 60 horsepower such that the volumetric flow rate capacity of vacuum generator 232 can be below 10,000 CFM.

In some aspects, hydraulic system 218 can be operatively connected to boom 270 to adjust the position of conduit 252. In some aspects, as shown in FIG. 3, hydraulic system 218 can include a hydraulic valve block 219 that includes a set of ports and valves to control the pressure of the hydraulic fluid and regulate the direction of the hydraulic fluid flow in hydraulic system 218. In some aspects, hydraulic system 218 can include one or more boom actuators 276, such as for example, a hydraulic cylinder with a reciprocating piston rod, configured to move boom 270 such that the position of conduit 252 can be adjusted in a lateral direction, a longitudinal direction, and a vertical direction. In some embodiments, hydraulic system 218 can drive frame actuator 288 (e.g., a hydraulic cylinder with a reciprocating piston rod) to adjust position of hook-lift frame 280 to load and unload other components of material collection system 10 on chassis 102 of vehicle 20.

Figure 13:
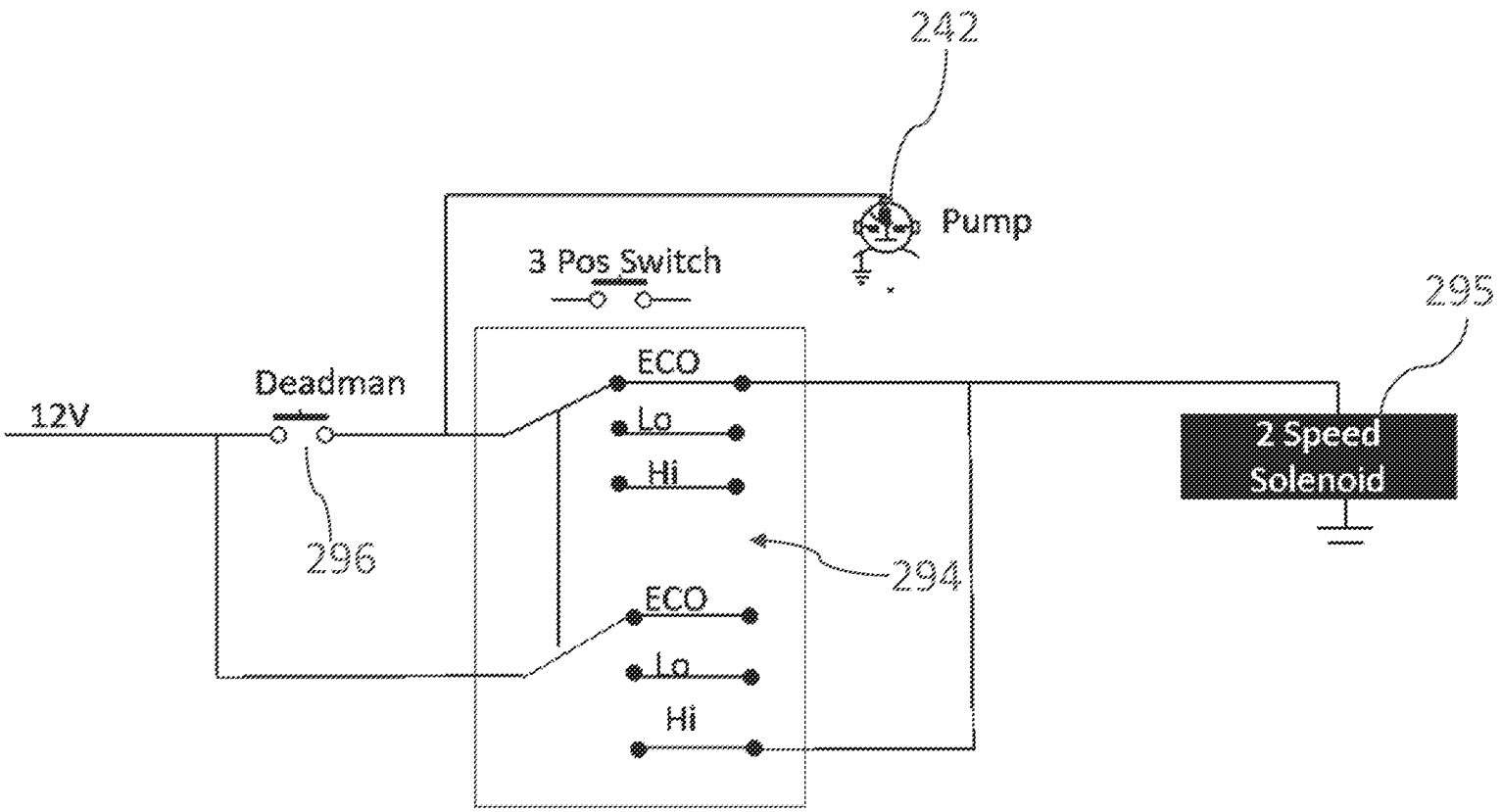
FIG. 13 is a schematic diagram of a pump switching circuit according to various aspects of the invention.

In some aspects, hydraulic system 218 can include a hydraulic motor and/or a pump 242 to drive hydraulic fluid to the one or more boom actuators 276 and frame actuators 288. In some embodiments, the hydraulic motor and/or pump 242 can be driven by a power takeoff operatively connected to the drive train (e.g., drive shaft 214) of vehicle 20. In some embodiments, the hydraulic motor and/or pump 242 can be powered by a DC power unit of vehicle's electrical system. In some aspects, hydraulic system 218 can include a switching circuit to control operation of hydraulic motor and/or pump 242. In some aspects, switching circuit can be provided through an enabling switch of a control system to protect against excess power draw from the hydraulic motor and/or pump 242. For example, as shown in FIG. 13, a three position switch 294 can be operatively linked to a deadman switch 296 to control operation of pump 242 so that pump 242 is not continuously operating when chassis engine 204 of vehicle 20 is running. In some embodiments, a two-speed solenoid 295 can be operatively linked with three position switch 294 to adjust operation of a throttle (e.g., throttle 212) to a high speed mode. As shown in FIG. 14, if deadman switch 296 is set to an off mode, pump 242 is set to an off mode, and if deadman switch 296 is set to an on mode, pump 242 is set to an on mode. When pump 242 is set to an off mode and the three-position switch 294 is set at a high speed mode, solenoid 295 sets the throttle to a hi-speed mode. When pump 242 is set to an on mode and the three-position switch 294 is set at a high-speed mode or an economy mode, solenoid 295 sets the throttle into a high speed mode. In some embodiments, the hydraulic motor and/or pump 242 can be supported on platform 284 of hook-lift frame 280, for example, proximate to the front end of platform 284 such that the hydraulic motor and/or pump 242 are disposed between container 220 and cab 104 of vehicle 20.

Figure 9:
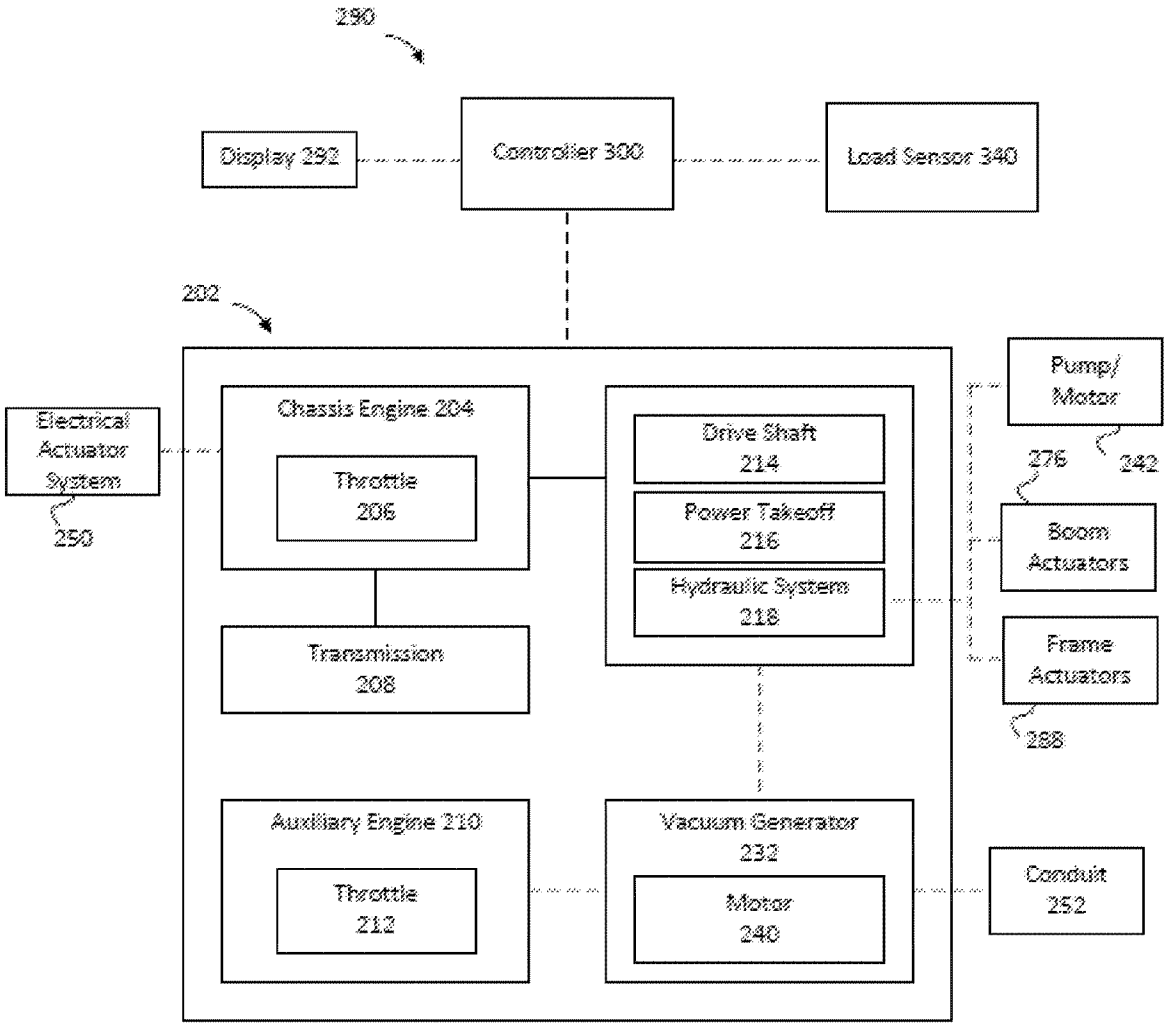
FIG. 9 is a block diagram of a control system for material collection system according to various aspects of the invention.

In some aspects, as shown in FIG. 9, power source 202 can include an electrical actuator system 250 operatively connected to boom 270 to adjust the position of conduit 252. Electrical actuator system 250 can be powered by chassis engine 204 (e.g., by the alternator of chassis engine 204), auxiliary engine 210, and/or power takeoff 216. In some aspects, actuator system 250 can include one or more motors (e.g., servomotors or stepper motors) configured to move boom 270 such that the position of conduit 252 can be adjusted in a lateral direction, a longitudinal direction, and a vertical direction. In some embodiments, the hydraulic system 218 can be replaced by electrical actuator system 250 such that the material collection system 10 uses only electrical actuator system 250 to adjust the position of boom 270.

In some aspects, material collection system 10 can include a control system 290 having a controller 300 operatively linked (e.g., wired connection or wireless connection) to any component of power source 202. For example controller 300 can control throttle 206 to adjust power output of chassis engine 204. Controller 300 can control throttle 212 to adjust power output of auxiliary engine 210. Controller 300 can control drive shaft 214 and power takeoff 216 to control power output to hydraulic pump and/or motor 240, 242. Controller 300 can be linked to electrical actuator system 250 to control power output to one or more motors of electrical actuator system 250. By controlling power output of any one of chassis engine 204, auxiliary engine 210, drive shaft 214, power takeoff 216, and electrical actuator system 250, controller 300 can control operation of vacuum generator 232 (e.g., adjust speed of fan), hydraulic system 218, and/or electrical actuator system 250 (e.g., adjust speed of hydraulic pump and/or motor 240, 242 to adjust position of conduit 252 and hook-lift frame 280).

In some aspects, controller 300 can adjust the speed of chassis engine 204 and/or auxiliary engine 210 to control the speed of vacuum generator 232. For example, vacuum generator 232 can be set at a higher speed, e.g., a work speed, when collecting material, and set at a lower speed, e.g., an idle speed, when not collecting material. In some aspects, the idle speed can correspond to chassis engine 204 and/or auxiliary engine 210 being set at approximately 1,200 RPM. In some aspects, the work speed can correspond to chassis engine 204 and/or auxiliary engine 210 being set in range between approximately 2,400 RPM and approximately 3,200 RPM.

Figure 10:
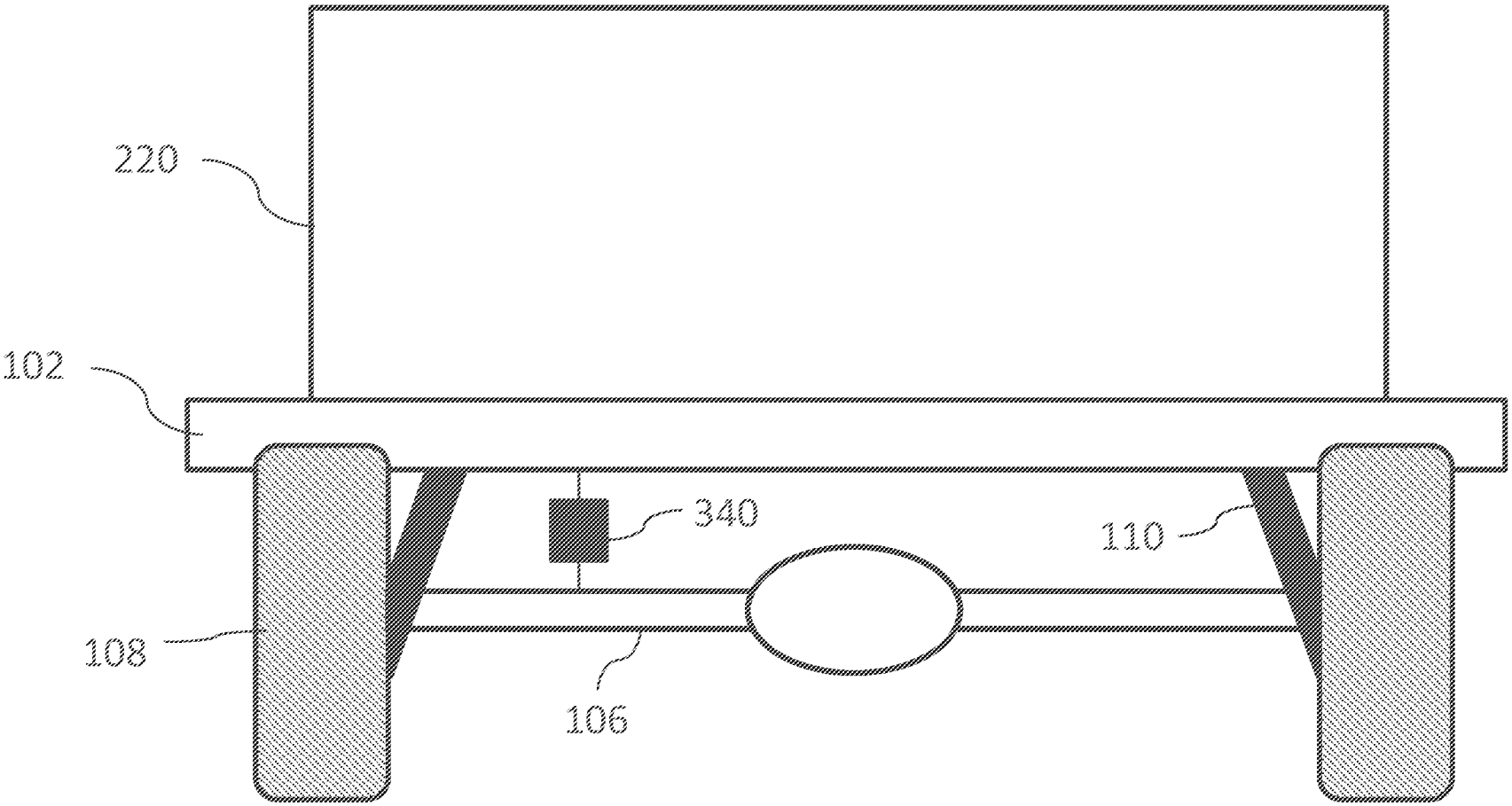
FIG. 10 is a schematic view of a load sensor operatively connected to a vehicle chassis and axle according to various aspects of the invention.

In some aspects, control system 290 can include one or more sensors to provide electronic signals indicative of system conditions (e.g., weight of a material collected in container 220). The one or more sensors can include digital and/or analog sensors. In some aspects, the one or more sensors can output amplified and/or unamplified signals. In some aspects, the one or more sensors can be self-contained in its own housing (i.e., they include the sensor and a power source). In some aspects, the one or more sensors can be modular or integrated into a component of material collection system 10. In other aspects, the one or more sensors can be a remote sensor such that power can be provided by a remote power source. In some aspects, the sensors can also use a variety of renewable power sources (e.g., solar power, ambient RF, thermoelectric, etc.) With reference to FIGS. 9 and 10, in some aspects, the one or more sensors in material collection system 10 can include a load sensor 340. As shown in FIG. 10, in some aspects, load sensor 340 may be disposed underneath container 220 and operatively connected to chassis 102 and/or axle 106 of vehicle 20 that is supported a pair of tires 108. In some aspects, load sensor 340 detects a load applied by the collected material received in container 220. In some aspects, load sensor 340 can transmit an output signal indicating the load applied by the collected material received in container 220.

In some aspects, load sensor 340 can detect the load applied by the collected material by monitoring the displacement between the chassis of the vehicle and an axle of the vehicle. For example, as shown in FIG. 10, vehicle 20 can include a suspension member 110 (e.g., spring) to support chassis 102 above axle 106. In some aspects, suspension member 110 can be compressed in response to a load applied by material collected in container 220 such that the displacement between axle 106 and container 220 is reduced. In some aspects, suspension member 110 can expand in response to material being removed from container 220 such that the displacement between axle 106 and container 220 is increased. In some aspects, load sensor 340 can monitor and detect the variable displacement between axle 106 and chassis 102 as collected material is added to container 220, where the detected displacement corresponds to a load applied by the collected material received in container 220.

In some aspects, load sensor 340 can detect the load applied by the collected material by measuring a force applied to chassis 102. For example, load sensor 340 can include one or more load cells disposed underneath container 220, where load cells convert the force applied by collected material to an electrical output, such as voltage.

In some aspects, controller 300 can be in electrical communication (e.g., wired or wirelessly) with load sensor 340. In some aspects, controller 300 can receive the output signal transmitted by load sensor 340 such that electronic data is inputted into a processor (e.g., processor 302 shown in FIG. 12) of a controller via an input/output module (e.g., I/O module 322 shown in FIG. 12). In some aspects, controller 300 can use the electronic data received from load sensor to determine a weight of the collected material received in container 220. In some aspects, controller 300 can determine an aggregate weight of vehicle 20 combined with loaded material collection system 10 by taking the sum of the weight of vehicle 20, weight of an unloaded material collection system 10, and the calculated weight of the collected material received in container 220.

In some aspects, when load sensor 340 detects displacement between chassis 102 and axle 106, controller 300 can use the monitored displacement to calculate the weight of collected material received in container 220. In some aspects, when load sensor 340 includes one or more load cells to detect force applied by collected material, controller 300 can use the monitored force to calculate the weight of collected material received in container 220.

In some aspects, in response to determining an aggregate weight of vehicle 20, controller 300 can compare the determined aggregate weight to a maximum operating weight. In some aspects, the maximum operating weight can be set to approximately 26,000 pounds to assist an operator in complying with non-commercial vehicle standards. In some aspects, the maximum operating weight may be set to be less than a weight that could overload components (e.g., vacuum generator 232, motor 240) the material collection system 10, thereby preventing damage to the material collection system 10 caused by overload. In some aspects, in response to determining the aggregate weight of the vehicle exceeds a maximum operating weight, controller 300 can adjust a speed of the vacuum generator 232 to an idle speed.

In some aspects, control system 290 can include a display 292 (e.g., a monitor, a screen) in electrical communication with controller 300. In some embodiments, display 292 may be disposed in cab 104 of vehicle 20 to be viewed by a driver. In some embodiments, display 292 can display the determined aggregate weight of vehicle 20. In some embodiments, display 292 can indicate a warning (e.g., by sound or a LED) to a driver of vehicle 20, such as for example, when aggregate weight of vehicle 20 exceeds the maximum operating weight.

Figure 11:
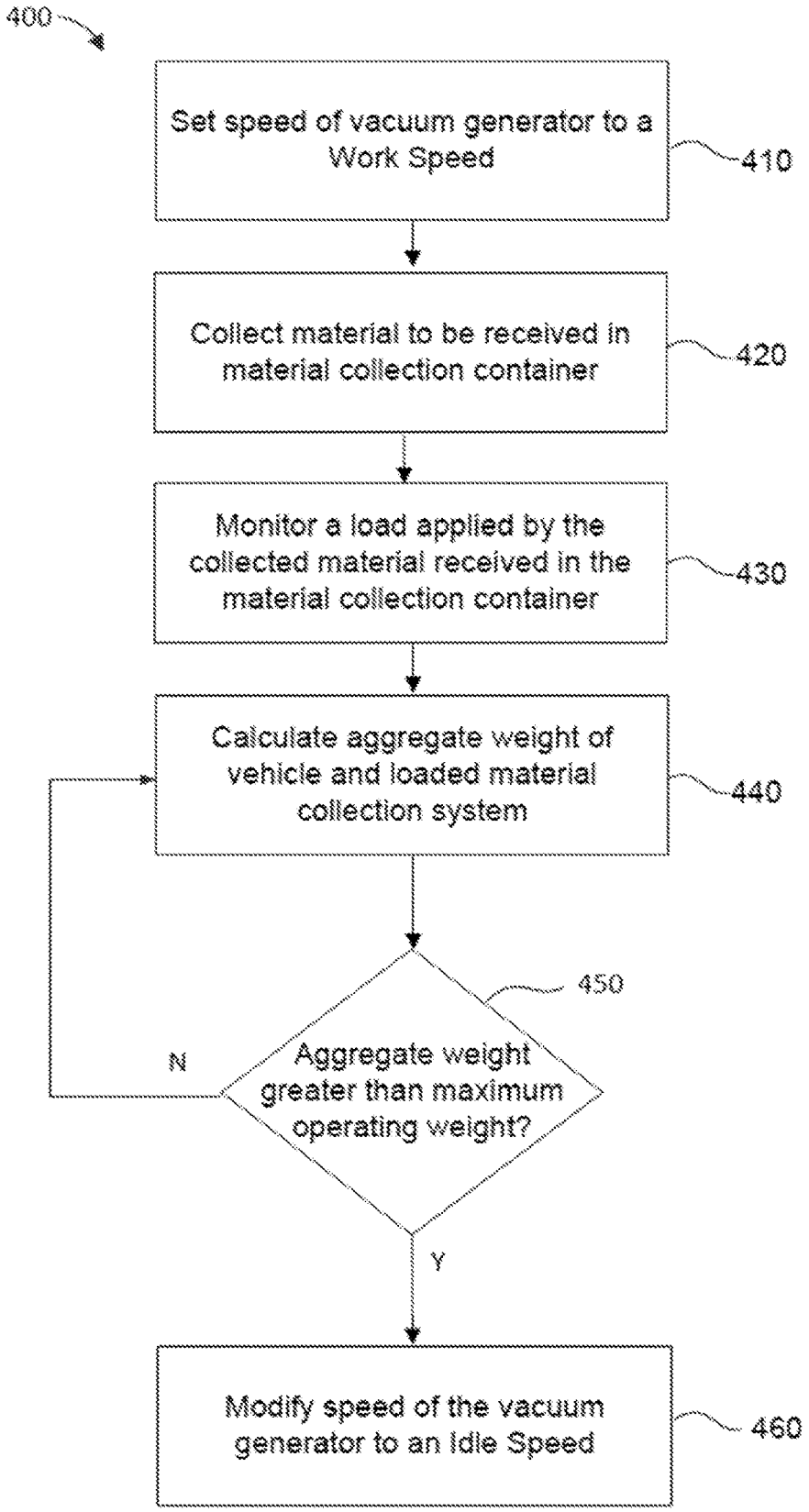
FIG. 11 is a flow chart of an example control protocol according to various aspects of the invention.

FIG. 11 shows a flow chart of an example method 400 executed by a processor, for operating material collection system 10 in a load monitoring mode 326.

In some aspects, method 400 can include a step 410 of setting vacuum generator at a work speed. In some aspects, step 410 can include raising the speed of chassis engine 204 and/or auxiliary engine 210, which in turn, increases the speed of the fan of vacuum generator 232. For example, step 410 can including setting the speed of chassis engine 204 and/or auxiliary engine 210 in a range between 2,400 RPM and 3,200 RPM that is suitable for generating airflow to draw material through intake end 258 of conduit 252.

In some aspects, method 400 can include a step 420 of collecting material that is to be received in container 220. In some aspects, step 420 can include using conduit 252 to intake material disposed along the pickup site. In some aspects, step 420 can include using boom 270 to adjust the position of the intake end 258 of conduit 252 in a longitudinal direction, a lateral direction, and/or a vertical direction along the pickup site surrounding vehicle 20.

In some aspects, method 400 can include a step 430 of monitoring a load applied by the collected material received in container 220. In some aspects, step 430 can include receiving and processing output signals transmitted by load sensor 340 to determine a load applied by the collected material received in container 220. In some aspects, step 430 can include receiving output signals periodically at predetermined time intervals (e.g., receiving one output signal per minute). In some aspects, step 430 can include calculating the weight of collected material received in container 220 based on the monitored displacement between vehicle chassis 102 and axle 106, as indicated by the output signal. In some aspects, step 430 can include calculating the weight of collected material received in container 220 based on the monitored forced applied by the load to chassis 102, as indicated by the output signal. In some aspects, step 430 can include applying correction factors, such as vehicle movement or load distribution in container 220, to calculate a more accurate of the weight of the collected material.

In some aspects, method 400 can include a step 440 of calculating an aggregate weight of vehicle 20 combined with loaded material collection system 10 by taking the sum of the weight of vehicle 20, weight of an unloaded material collection system 10, and the calculated weight of the collected material received in container 220. In some aspects, step 440 includes retrieving stored values corresponding to the weight of vehicle 20 and the weight of an empty container 220 from a memory (e.g., main memory 308) of controller 300.

In some aspects, method 400 can include a step 450 of determining whether the aggregate weight of vehicle 20 and loaded material collection system 10 is greater than a maximum operating weight. In some aspects, step 450 can include retrieving a stored value corresponding to maximum operating weight from a memory (e.g., main memory 308)

of controller 300. In some aspects, maximum operating weight may be set at approximately 26,000 pounds to determine whether vehicle 20 meets non-commercial license driving requirements.

In response to determining that the monitored load is greater than maximum operating weight, method 400 can return to step 430 to continue monitoring the load applied by the collected material received in the collection container 220. While returning to step 430, method 400 can include continuing to keep vacuum generator set at a working speed so that material may be collected by conduit 252 efficiently.

In some aspects, in response to determining that the monitored load is greater than maximum operating weight, method 400 can include a step 460 of modifying the speed of vacuum generator 232 to an idle speed, such that material collection system 10 is not collecting any more material. In some aspects, step 460 can include lowering the speed of chassis engine 204 and/or auxiliary engine 210, which in turn, decreases the speed of the fan of vacuum generator 232. For example, step 460 can including setting the speed of chassis engine 204 and/or auxiliary engine 210 at approximately 1,200 RPM.

In some aspects, in response to determining that the monitored load is greater than maximum operating weight, method 400 can include actuating display 292 to indicate a warning, such as generating a message on a screen or illuminating an LED, that aggregate weight of vehicle 20 and loaded material collection system 10 exceeds maximum operating weight.

In some aspects, controller 300 can be configured to execute a method before collecting and loading further material into container 220 of material collection system. In some aspects, the method can include a step of raising chassis 102 of vehicle 20 in a direction away from axle 106 until the presence of chassis 102 cannot be detected by load sensor 340. In some aspects, the method can include a step of lowering chassis 102 of vehicle 20 down toward axle 106 of vehicle 20 when determining that the presence of chassis 102 cannot be detected by load sensor 340.

Figure 12:
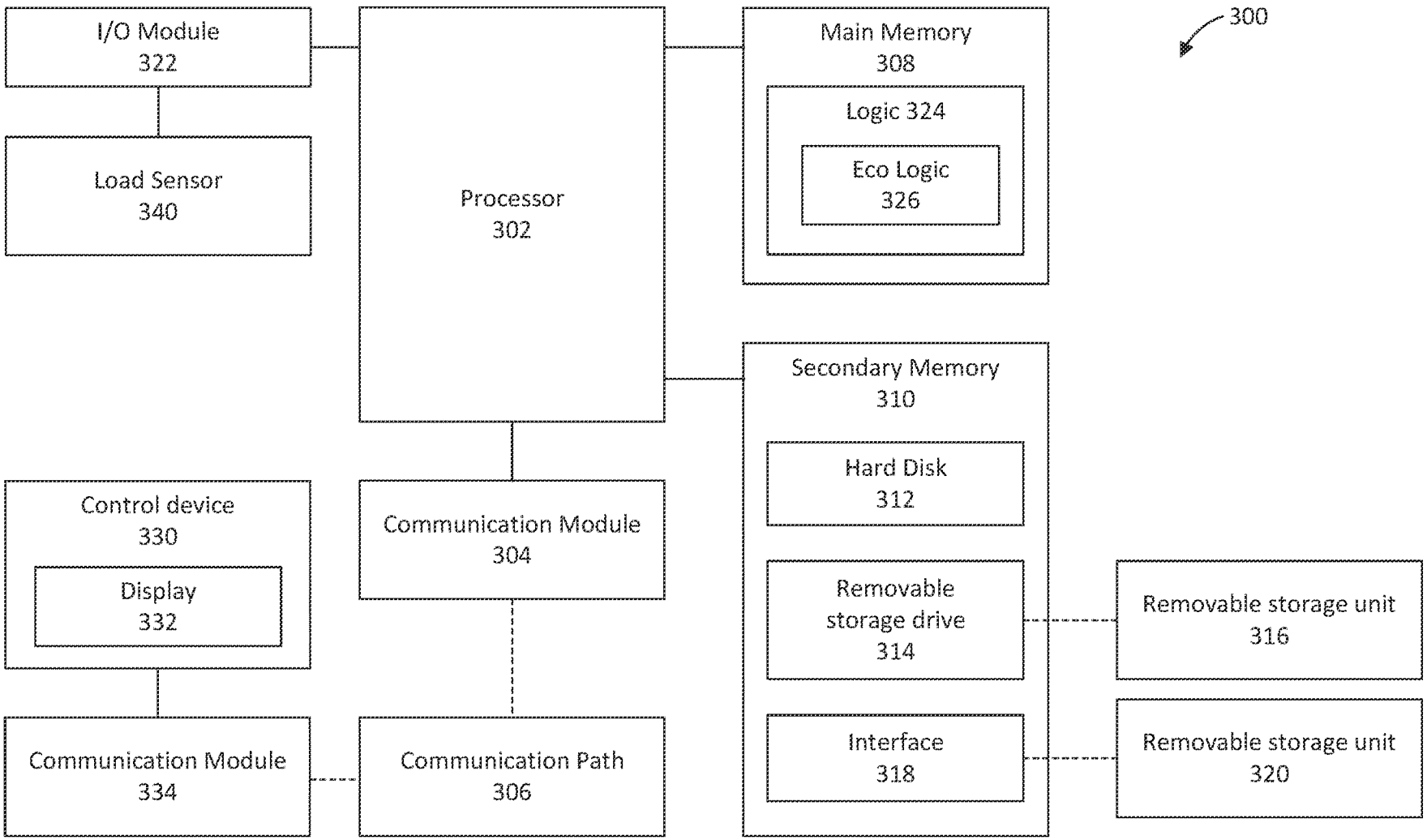
FIG. 12 a block diagram of an example control system according to various aspects of the invention.

With reference to FIG. 12, in some aspects, controller 300 can be implemented as computer-readable code. For example, processing of operator inputs and field inputs, or control of material collection system 10 components can be implemented in controller 300 using hardware, software, firmware, tangible non-transitory computer readable media having instructions, data structures, program modules, or other data stored thereon, or a combination thereof, and can be implemented in one or more computer systems or other processing systems. Material collection system 10 can include all or some of the components of controller 300 for implementing processes discussed herein.

In some aspects, computer programs (also called computer control logic) such as logic 324 are stored in main memory 308 and/or secondary memory 310. Computer programs can also be received via communication module 304. Such computer programs, when executed, enable controller 300 to implement the embodiments as discussed herein. In particular, the computer programs, when executed, enable processor 302 to implement the processes of the embodiments discussed here. Where the embodiments are implemented using software, the software can be stored in a computer program product and loaded into controller 300 using removable storage drive 314, interface 318, and hard disk drive 312, or communication module 304.

Embodiments of the invention(s) also can be directed to computer program products comprising software stored on any computer useable medium. Such software, when executed in one or more data processing device, causes a data processing device(s) to operate as described herein. Embodiments of the invention(s) can employ any computer useable or readable medium. Examples of computer useable mediums include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nanotechnological storage device, etc.).

In some aspects, if programmable logic is used, such logic can be executed on a commercially available processing platform or a special purpose device. One of ordinary skill in the art can appreciate that embodiments of the disclosed subject matter can be practiced with various computer system configurations, including multi-core multiprocessor systems, minicomputers, and mainframe computers, computer linked or clustered with distributed functions, as well as pervasive or miniature computers that can be embedded into virtually any device.

For instance, at least one processor device and a memory can be used to implement the above described embodiments. A processor device can be a single processor, a plurality of processors, or combinations thereof. Processor devices can have one or more processor "cores."

Various embodiments of the invention(s) can be implemented in terms of example controller 300. After reading this description, it will become apparent to a person skilled in the relevant art how to implement one or more of the invention(s) using other computer systems and/or computer architectures. Although operations can be described as a sequential process, some of the operations can in fact be performed in parallel, concurrently, and/or in a distributed environment, and with program code stored locally or remotely for access by single or multi-processor machines. In addition, in some aspects the order of operations can be rearranged without departing from the spirit of the disclosed subject matter.

In some aspects, logic 324 can be downloaded to processor 302 and stored in main memory 308 and/or secondary memory 310. Logic 324 can include control logic related to various operational modes and/or various operations of material collection system 10. The operations can be defined using control modules and/or sequences that can run alone, in parallel, or in a phase (i.e., a grouping of sequences). In some aspects, logic 324 can include logic for operational modes including load monitoring mode 326. In some aspects, logic 324 including logic for load monitoring mode 326, is modifiable online and/or offline with access credentials (i.e., developer rights to software).

In some aspects, a processor 302 can be a special purpose or a general purpose processor device. As will be appreciated by persons skilled in the relevant art, processor 302 can also be a single processor in a multi-core/multiprocessor system, such system operating alone, or in a cluster of computing devices operating in a cluster or server farm. Processor 302 can be connected to a communication module 304, for example, a bus, message queue, network, or multi-core message-passing scheme.

In some aspects, controller 300 can include main memory 308, for example, volatile memory, such as random access memory (RAM), or nonvolatile memory, such as read-only memory (ROM). In some aspects, controller 300 can further include a secondary memory 310. Secondary memory 310 can include, for example, a hard disk drive 312, or a removable storage drive 314. Removable storage drive 314 can include a floppy disk drive, a magnetic tape drive, an optical disk drive, a flash memory, or the like. The removable storage drive 314 reads from and/or writes to a removable storage unit 316 in a well-known manner. Removable storage unit 316 can include a floppy disk, magnetic tape, optical disk, a universal serial bus (USB) drive, etc. which is read by and written to by removable storage drive 314. As will be appreciated by persons skilled in the relevant art, removable storage unit 316 can include a computer usable storage medium having stored therein computer software and/or data.

In other aspects, secondary memory 310 can include other similar means for allowing computer programs or other instructions to be loaded into controller 300. Such means can include, for example, removable storage unit 316 and an interface 318. Examples of such means can include a program cartridge and cartridge interface (such as that found in video game devices), a removable memory chip (such as an EPROM, or PROM) and associated socket, and other removable storage units 320 and interfaces 318 which allow software and data to be transferred from the removable storage unit 320 to controller 300.

In some aspects, controller 300 can also include a communication module 304. Communication module 304 can allow software and data to be transferred between controller 300 and external devices. Communication module 304 can include a modem, a network interface (such as an Ethernet card), a communication port, a PCMCIA slot and card, or the like. Software and data transferred via communication module 304 can be in the form of signals, which can be electronic, electromagnetic, optical, or other signals capable of being received by communication module 304. These signals can be provided to communication module 304 via a communication path 306. Communication path 306 can carry signals and can be implemented using wire or cable, fiber optics, a phone line, a cellular phone link, an RF link or other communication channels.

In this document, the terms "computer program medium" and "computer usable medium" are used to generally refer to media such as removable storage unit 316, removable storage unit 320, and a hard disk installed in hard disk drive 312. Computer program medium and computer usable medium can also refer to memories, such as main memory 308 and secondary memory 310, which can be memory semiconductors (e.g., DRAMs, etc.).

Throughout the disclosure, components can be referred to with reference to a material collection system 10, but it will be appreciated that the disclosed systems and methods can be applicable to other embodiments as well, and can include additional functionalities (e.g., sweeping, sewer cleaning, contamination removal, excavation, and/or landscaping).

It is to be appreciated that the Detailed Description section, and not the Summary and Abstract sections, is intended to be used to interpret the claims. The Summary and Abstract sections can set forth one or more but not all exemplary embodiments of the present embodiments as contemplated by the inventor(s), and thus, are not intended to limit the present embodiments and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the embodiments that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the following claims and their equivalents.

What is claimed is:

1. A material collection system mounted on a vehicle, comprising:

a hook-lift frame removably mounted to a chassis of the vehicle;

a conduit including a material inlet;

a boom supporting the conduit, the boom being movable from a stowed position to an operating position;

a vacuum generator coupled to the conduit, the vacuum generator configured to generate airflow for drawing material into the material inlet;

an engine configured to power the vacuum generator; and a material collection container to receive the collected material from the conduit, wherein the conduit, vacuum generator, the engine, and the material collection container are supported on the hook-lift frame, wherein the hook-lift frame is configured to move the conduit, the vacuum generator, the engine, and the material collection container on and off the chassis of the vehicle.

2. The material collection system of claim 1, wherein the material collection container comprises a nose extension disposed at a front end of the container, and the vacuum generator and the engine are disposed below the nose extension of the material collection container.

3. The material collection system of claim 1, further comprises:

a hydraulic system configured to move the boom between the stowed position and the operating position to adjust a location of the material inlet.

4. The material collection system of claim 1, wherein the vacuum generator is configured to generate the airflow at a volumetric flow rate between approximately 4,000 CFM and approximately 10,000 CFM for drawing material into the material inlet.

5. The material collection system of claim 1, wherein the engine is a diesel engine.

6. The material collection system of claim 1, wherein the vacuum generator includes an impeller, and the impeller has a diameter in a range between approximately 18 inches and approximately 22 inches.

7. The material collection system of claim 1, wherein the engine is configured to provide motive power to the vehicle.

8. The material collection system of claim 1, wherein the hook-lift frame comprises:

a base configured to be removably mounted to the chassis of the vehicle, a platform rotatably coupled to the base, wherein the vacuum generator, the engine, and the material collection container are received on the platform.

9. The material collection system of claim 8, wherein the hook-lift frame further comprises:

a frame hydraulic actuator operatively connected to the base and the platform, the frame hydraulic actuator configured to pivot the platform between a loading position and an unloading position.

10. The material collection system of claim 1, wherein the material collection container comprises a storage volume in a range between approximately 10 cubic yards and approximately 20 cubic yards.

11. The material collection system of claim 2, wherein the nose extension includes an inlet defining an opening into the container and disposed at a bottom end of the nose extension, and the vacuum generator includes an outlet port directly connected to the inlet of the nose extension.

12. The material collection system of claim 11, wherein the bottom end of the nose extension is inclined at an angle in a range between approximately 5 degrees and approximately 40 degrees with respect to a plane extending parallel to horizontal.

13. A material collection system mounted on a vehicle, comprising:

a hook-lift frame removably mounted to a chassis of the vehicle;

a conduit including a material inlet adjustable to a variety positions around the vehicle;

a vacuum generator coupled to the conduit, the vacuum generator configured to generate airflow for drawing material into the material inlet;

an engine configured to power the vacuum generator; and a material collection container to receive the collected material from the conduit, wherein the conduit, vacuum generator, the engine, and the material collection container are supported on the hook-lift frame.

14. The material collection system of claim 13, wherein the conduit comprises a flexible material.

15. The material collection system of claim 13, wherein a length of the conduit is in a range between approximately 6 feet and approximately 12 feet.

16. The material collection system of claim 13, wherein a length of the conduit is adjustable.

17. The material collection system of claim 13, wherein the engine is configured to provide motive power to the vehicle.

18. The material collection system of claim 13, further comprising a broom supporting the conduit to adjust the material inlet to the variety positions around the vehicle.

19. The material collection system of claim 13, wherein the hook-lift frame comprises:

a base configured to be removably mounted to the chassis of the vehicle, a platform rotatably coupled to the base, wherein the vacuum generator, the engine, and the material collection container are received on the platform.

20. The material collection system of claim 19, wherein the hook-lift frame further comprises:

a frame hydraulic actuator operatively connected to the base and the platform, the frame hydraulic actuator configured to pivot the platform between a loading position and an unloading position.

* * * * *